United States Patent [19]

Degen

[11] 4,251,891

[45] Feb. 24, 1981

[54] UNDER MATTRESSES FOR BED FURNITURE

[75] Inventor: Hugo Degen, Seltisberg, Switzerland

[73] Assignee: Marpal AG, Chur, Switzerland

[21] Appl. No.: 959,140

[22] Filed: Nov. 9, 1978

[30] Foreign Application Priority Data

Nov. 15, 1977 [CH] Switzerland ..... 13967/77

[51] Int. Cl.[3] ..... A61G 7/00; A47C 20/04

[52] U.S. Cl. ..... 5/191; 5/68; 5/77; 5/238

[58] Field of Search ..... 5/66–68, 5/77, 191, 237, 238

[56] References Cited

U.S. PATENT DOCUMENTS

| | | | |
|---|---|---|---|
| 3,127,783 | 4/1964 | Martins | 5/66 |
| 3,176,323 | 4/1965 | Degen | 5/238 |
| 3,353,193 | 11/1967 | Greiner | 5/66 |
| 3,854,154 | 12/1974 | Degen | 5/66 |
| 3,974,530 | 8/1976 | Lugch et al. | 5/66 |

*Primary Examiner*—Casmir A. Nunberg
*Attorney, Agent, or Firm*—Neil F. Markva

[57] ABSTRACT

An under-mattress for bed furniture has an adjustable head part which can be continuously adjusted in its inclined position in both directions, without first having to be returned to its starting position. The horizontal pivoting axis of the head part is chosen such that it divides the head part into two sections, the smaller one of which is nearer the foot of the bed and, as the head part is raised, forms a hollow for the shoulder of a person lying on his side (FIGS. 2 and 13).

17 Claims, 15 Drawing Figures

FIG.4
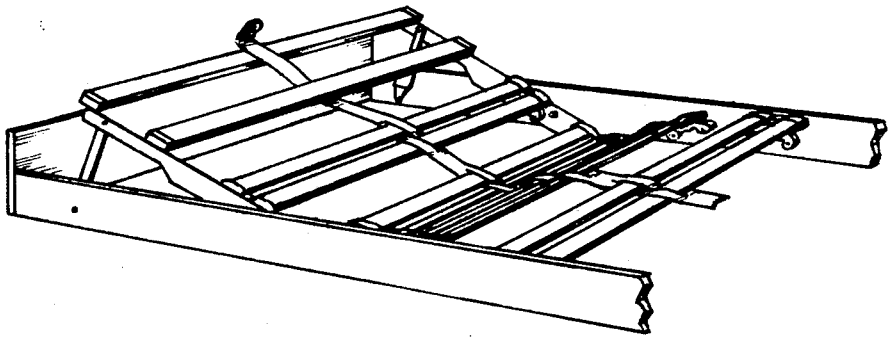
FIG.5
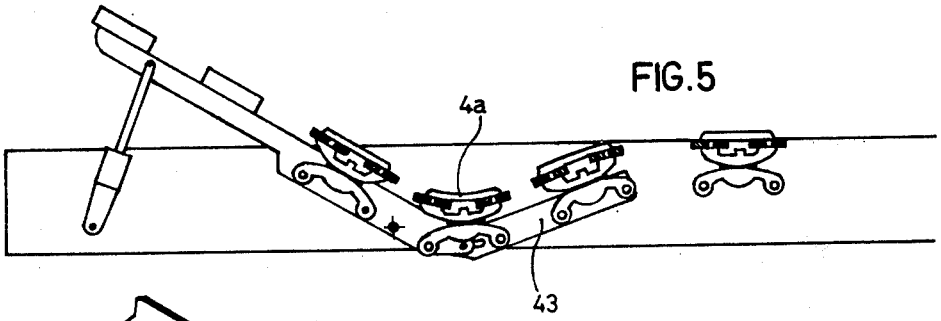
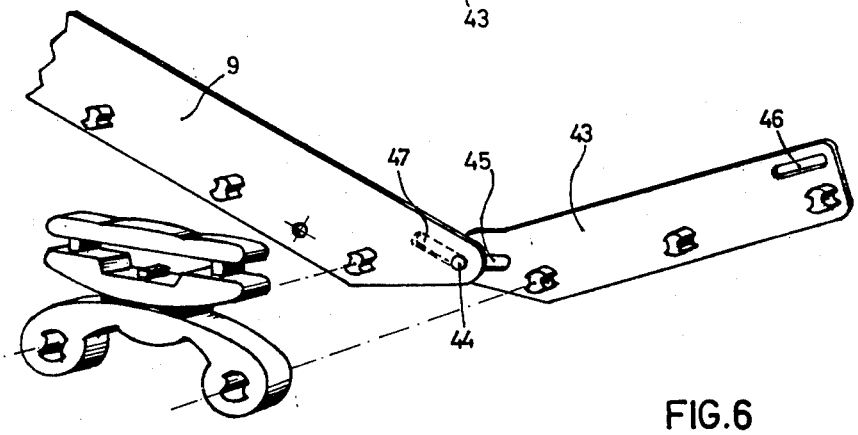
FIG.6

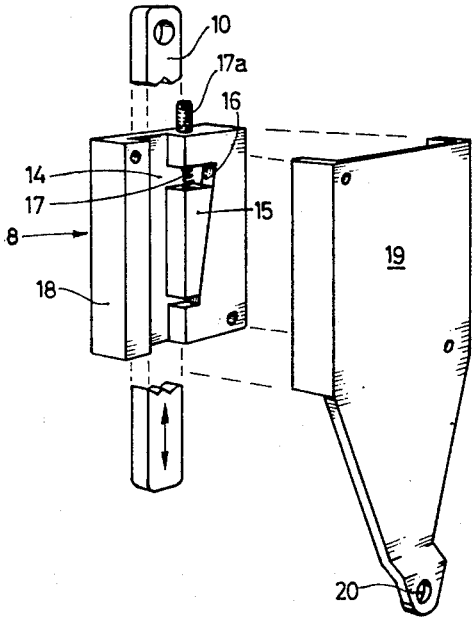
FIG. 12
FIG. 13a
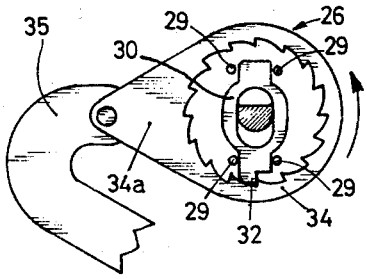
FIG. 13
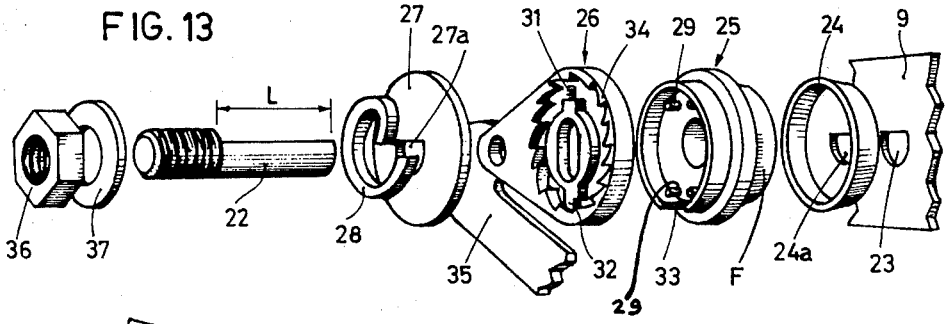
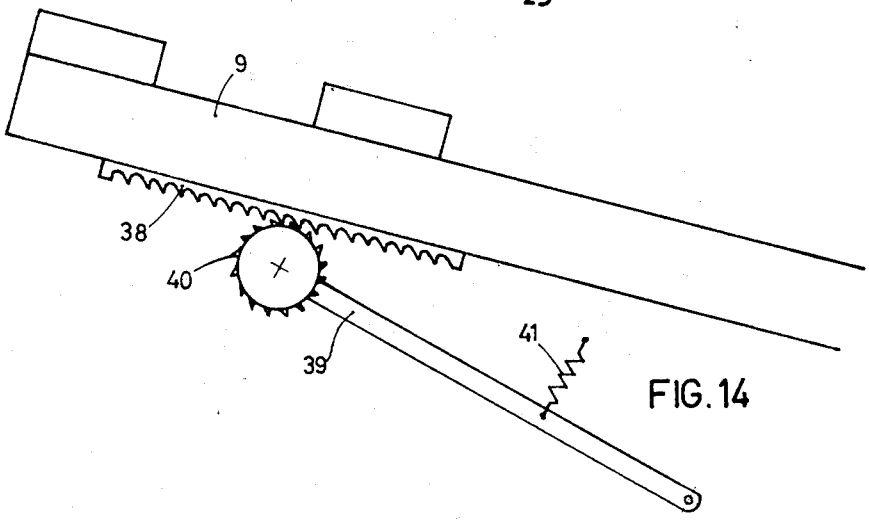
FIG. 14

UNDER MATTRESSES FOR BED FURNITURE

FIELD OF THE INVENTION

The invention relates to an under-mattress for bed furniture, comprising a frame and supporting members disposed inside the frame for supporting an over-mattress. The head part of the frame is pivotable about a pivoting axis transverse to the longitudinal axis of the under-mattress so as to be positionable in various inclined positions so that the head part can occupy a position at an angle to the remaining reclining surface of the under-mattress. The head part is fixable in the angled position by means of an adjusting device disposed between the head part and the frame of the under-mattress.

BACKGROUND OF THE INVENTION

Bed furniture is known whose under-mattress have a so-called head part which can be fixed by means of a scissor-like notched mechanism in various inclined positions determined by the notching. In the case of this known design, continuous adjustment of the inclined position is not possible. Furthermore there is the even more inconvenient disadvantage that it is only possible to adjust and fix the desired angle of inclination by raising, i.e. moving upwards, the head part. Each time the head part is readjusted to a lower angle of inclination therefore it must—together with the mattress and pillows—first be raised to its highest position and then be lowered completely, after which the desired inclination may be chosen. As is known from experience, most people sleep alternately on their side and their back or stomach and each of these preferred sleeping positions correspond to a specific inclination of the head part so that ideally the latter should be adjusted several times a night. The fact that this periodic adjustment, i.e. adaptation to a new sleeping position, is not customary at present is due entirely to the deficiencies of the existing under-mattress designs.

A further drawback of the conventional head part design is the fact that the head part may only be progressively raised at an angle with respect to the remainder of the under-mattress, while the anatomical features of the intermediate area between the shoulder and the neck region are not taken into account. The result of this unfortunate state of affairs which is familiar to almost every person in the civilized world today is the continuous battle with the pillow in the restless search for a position of rest that will permit both the neck region and the shoulder muscles to relax at the same time.

SUMMARY OF THE INVENTION

According to the invention an under-mattress for bed furniture comprises a frame and supporting members disposed inside the frame for supporting an over-mattress. The head part of the frame is pivotable about a pivoting axis transverse to the longitudinal axis of the under-mattress so as to be positionable in various inclined positions so that the head part can occupy a position at an angle to the remaining reclining surface of the under-mattress. The head part is fixable in the angled position by means of an adjusting device disposed between the head part and the frame of the under-mattress. The pivoting axis divides the head part into two sections, a smaller of which is nearer the foot of the under-mattress. The position of the pivoting axis is selected such that, as the larger section of the head part is raised, the said smaller section is pivoted downwards below the reclining surface of the under-mattress and thus forms a hollow in the reclining surface for the shoulder region of a person lying on his side.

The head part of a preferred under-mattress may thus be continuously adjusted substantially without effort by pressure alone in both directions, i.e. both downwards and upwards. In addition, the person lying on his side can position the awkward anatomical intermediate area between the shoulder and the head without tension and can attain the most comfortable position for himself by means of any adjustment, without having to leave his rest position, e.g. having to sit up in bed.

BRIEF DESCRIPTION OF DRAWINGS

The invention will be further described, by way of example, with reference to the accompanying drawings, in which:

FIGS. 4 to 6 show another embodiment in views corresponding to FIGS. 1 to 3, respectively;

FIGS. 12 to 14 illustrate the constructional details of some preferred embodiments.

DETAILED DESCRIPTION

Figure 1:
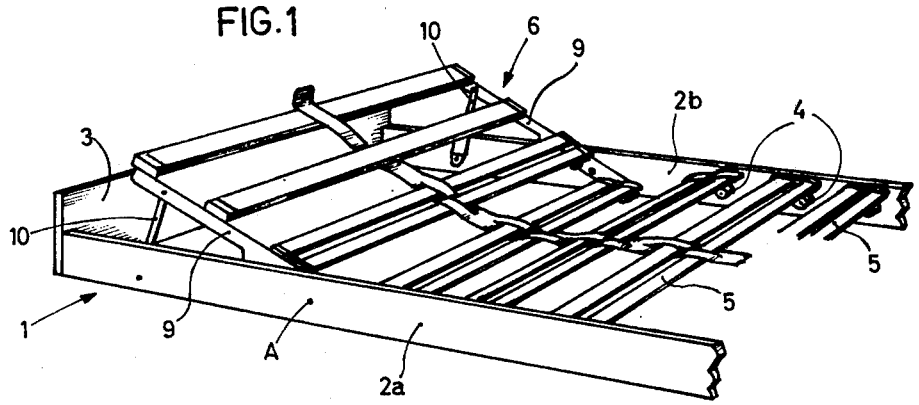
FIG. 1 is a simplified perspective view of part of a preferred under-mattress with a head part raised.

The under-mattress shown in part in FIG. 1 has a frame 1, of which two longitudinal side pieces 2*a*,2*b* and an end wall 3 are visible. Resilient support members 4, on which are mounted the end portions of flexible cross-pieces 5 intended to support the over-mattress (not shown), are secured to the inner surfaces of the two longitudinal side pieces in known manner.

In the front portion nearest the head of a reclining person, the under-mattress has a head part 6 which is pivotably mounted on the longitudinal side pieces 2*a*,2*b* about a horizontal axis A. The head part may therefore be raised or lowered in the direction of the double arrow 7 (FIG. 2), so that it forms an angle $\alpha$ with the remaining part of the under-mattress. An adjustment device 8, the construction and operation of which are described below, at each side is provided to fix the head part 6 at its inclined position in each case.

Figure 2:
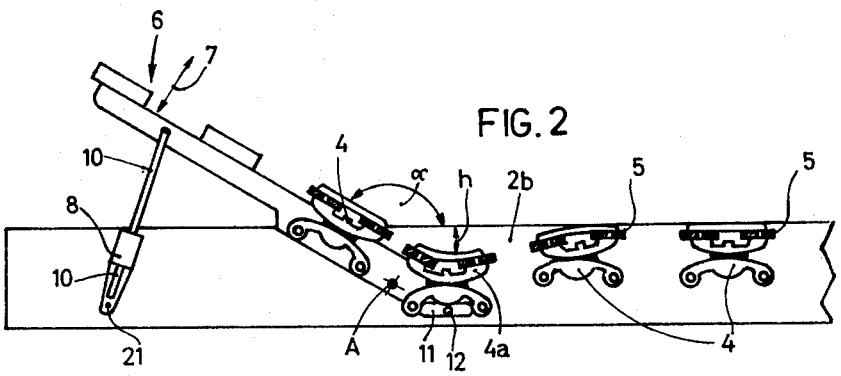
FIG. 2 is a vertical section taken parallel to the longitudinal axis of the under-mattress of FIG. 1.
Figure 7:
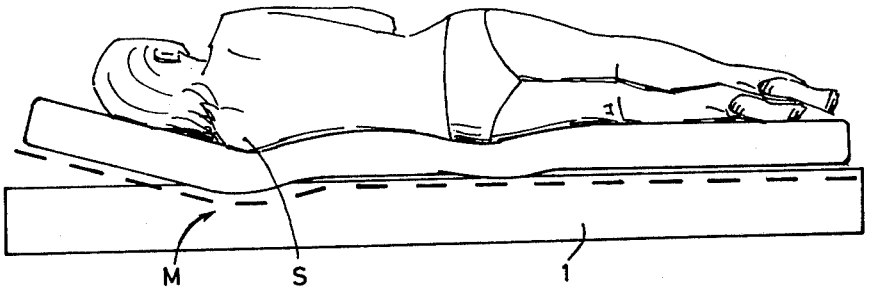
FIG. 7 is a diagrammatic view of the loading of a preferred under-mattress by a person lying on his side.
Figure 8:
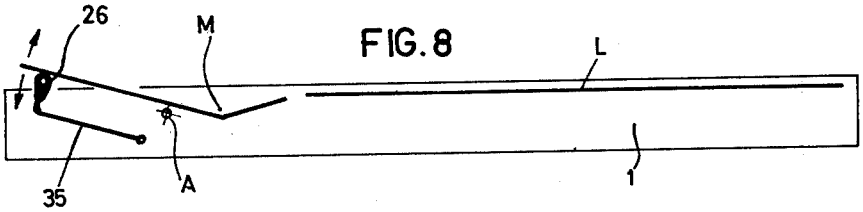
FIGS. 8 to 11 show various embodiments of head part adjustment devices.
Figure 9:
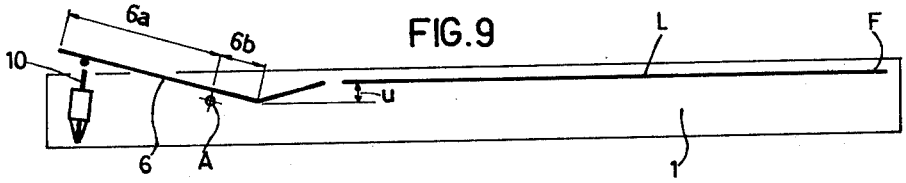

The head part 6 has two metal side pieces 9 which are supported on the adjustment device 8 disposed on either side of the frame 1 by way of support rods 10. As shown in FIG. 2, the axis A is disposed not at the lower end of the head piece 6, but somewhat higher, so that it divides the head part into two sections 6*a* and 6*b* (see diagrammatic representation of FIG. 9). In this way the head part 6 acts as a two-armed lever as it pivots. As is shown in particular by the diagrammatic representation in FIG. 9, the smaller section 6*b* nearer the foot F of the under-mattress sinks below the level of the reclining surface L as the larger section 6*a* is raised. This region may be referred to as the shoulder support section. The extent u of this sinking depends upon the position of the axis A and the size of the angle of adjustment $\alpha$. This arrangement therefore produces a hollow M (FIGS. 7 and 8) when the head part 6 is raised, and this hollow can receive the shoulder S of a person lying on this side. In this way, the awkward intermediate area between body and shoulder and between shoulder and head which tends easily to become tense may be positioned anatomically correctly by selecting accordingly the angle of adjustment corresponding in each case to a specific depth of the hollow for the shoulder.

Figure 3:
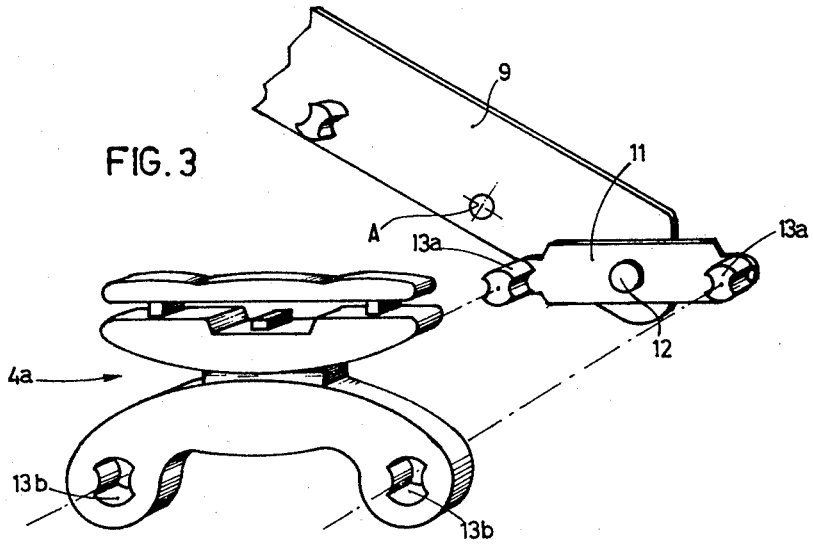
FIG. 3 is a perspective view of a detail of an embodiment of the mounting of the head part.

One structural arrangement for the mounting of the head part is shown in FIGS. 2 and 3. A rocker 11 which is mounted so as to be pivotable about an axis 12 is disposed at the lower end of each side piece 9. The rocker 11 bears fastening members 13*a* which project into correspondingly shaped recesses 13*b* and thus hold the support member 4*a* in known manner when it is assembled. This movable mounting permits the support member 4*a* to adapt to the shape of the mattress or shoulders in any position when lowered.

In FIGS. 4 to 6, which show a structural variation of the embodiment shown in FIGS. 1 to 3, the reference numbers have been retained for the parts which have remained the same. In contrast to the embodiment of FIGS. 1 to 3, in this case the end of each side piece 9 is not provided with a rocker 11 (FIG. 3) but is connected to a guide member 43 in an articulated manner. It may be connected for example by means of a pin 44 which projects into a longitudinal slot 45 of the guide member 43, which follows the sliding path which is necessarily formed during pivoting. In this embodiment, the guide member 43 is then pivotably mounted at its end opposite the longitudinal slot 45 with a pin in the frame 1. The said sliding path may however also be taken by means of a longitudinal slot 46 disposed at the free end of the guide member or by means of a longitudinal slot 47 (broken lines) disposed on the end portion of the side piece 9.

Although the device permits the shoulder area to be lowered, it would still have disadvantages in the manner described above if it were used with the known locking head-adjustment devices. When lying down there is always a desire sporadically to lower the shoulders as described when the person resting or sleeping turns from the back or stomach position on to his side. This requires that the inclination of the head part should be adjusted downwards without effort and in an infinitely variable manner merely by pressure with the head, shoulders or elbows. Such an adjustment, which is effected solely by exerting pressure but which ensures a secure fixing in the selected inclined position, should ideally be carried out even while half asleep after a certain amount of practice.

In order to achieve this, an adjustment device, which is described below by way of three embodiments, is inserted between the upper larger portion 6*a* of the head part and the frame 1 of the under-mattress.

The support rods designated 10 in FIGS. 2 and 12 are on the one hand articulated on the corresponding side piece 9 of the head part 6, and on the other hand guided in a brake mechanism 8 which is pivotably disposed on the frame 1. As the head part 6 is raised the guide rod 10 is pulled through the brake mechanism 8 which can follow the continuously varying angular position of the guide rod on account of its pivotable mounting.

The brake mechanism 8, the construction of which is shown in FIG. 12, has a guide path 14 for the support rod 10, against which a wedge 15, slidably mounted on an oblique surface 16, abuts. The face of the wedge 15 furthest from the oblique surface 16 is held in constant contact with the support rod 10 by means of a helical spring 17. An adjusting screw 17*a* acting upon the helical spring 17 makes it possible to adjust the bearing pressure of the wedge 15 on the support rod 10, and thus the frictional resistance according to need.

If the support rod 10 is drawn upwards as the head part 6 is raised, it brings the wedge 15 into a higher position against the force of the spring. In this case the frictional resistance between the wedge and the support rod is very slight and the head part may thus be pulled upwards without effort.

It is different however when the head part is lowered. The wedge is then brought downwards by the support rod through friction, and it draws closer to the rod on account of the oblique surface 16 an seeks to brake the said rod. By suitable choice of the angle of the wedge, the coefficient of friction and the initial tension in the spring, the braking force can be selected such that effortless adjustment is possible while it is ensured that the head part will not give way under the weight of the head lying on it.

In the embodiment illustrated, a cover 19, the lower prolongation of which has a bore 20 for taking a pivot pin 21 (FIG. 2), is fastened by screws on to the main part of the braking device designated 18.

The head part may thus be moved in both directions upwards and downwards, in an infinitely variable manner, wherein movement upwards meets with little resistance, while movement downwards meets with greater resistance. Resistance to downward movement may be adjusted in such a way that, during movement (of the sleeping person) from the side position to the back position, the head part may be pressed down merely by pressure of the head or the hand or arm and after a certain amount of practice may be carried out almost involuntarily, i.e. while half asleep.

A further embodiment of the adjustment device is shown in FIGS. 13 and 13*a*. In this case a bolt 22 is secured on the side piece 9 of the head part, the profile of the said bolt being flattened over part of its length L and thereby fitting the cross-section of an opening 23. When fixed in this opening 23, the bolt 22 is prevented from rotating. On the partial length L of the bolt there are disposed a frusto-conical brake ring 24, a brake drum 25, a ratchet mechanism 26, a cover plate 27 and a flat spring 28. Only the brake ring 24 and the cover plate 27 are connected rotatingly rigidly to the bolt 22 by means of their profiled bores 24*a*,27*a*, while the brake drum 25 and the ratchet mechanism 26 are mounted freely rotatably on the bolt 22.

The brake drum 25 has a tapered brake surface F which matches the inner surface of the brake ring 24 and can produce a braking effect in cooperation with the latter. In addition, on its side opposite the brake surface F, the brake drum has four retaining pins 29 which are used for loosely holding and guiding a dog 30. The dog 30 is lightly tensioned by a spring 31 and can move up and down to a certain extent inside the retaining pins 29. Catch 32 of the dog projects through a lower opening 33 in the brake drum 25 into the internal toothing of the ratchet wheel 34. A support rod 35 (FIG. 8), which is pivoted on the frame of the under-mattress, engages eccentrically on the other side with a lateral prolongation 34*a* of the ratchet wheel. The individual parts, shown in an exploded view in FIG. 13 for the sake of clarity, are held together after assembly on the bolt 22 by a nut 36 with a washer 37.

As the head part is raised, the ratchet wheel 34 is rotated in the direction of the arrow (FIG. 13*a*) by the rod 35 mounted in a stationary but articulated manner. The dog 30 then passes unhindered over the internal toothing of the ratchet wheel and therefore offers no appreciable resistance to the displacement of the head part. If on the other hand the head part is lowered, the ratchet wheel 34 takes the dog 30 along with it, the rotary motion of which is transmitted to the brake drum 25 by way of the retaining pins 29. Depending upon the axial pressure exerted by the spring 28, the brake surface F of the brake drum is now pressed against the inner surface of the brake ring 24 so that the head part can only be lowered by overcoming this frictional resistance, but again in an infinitely variable manner.

Figure 11:
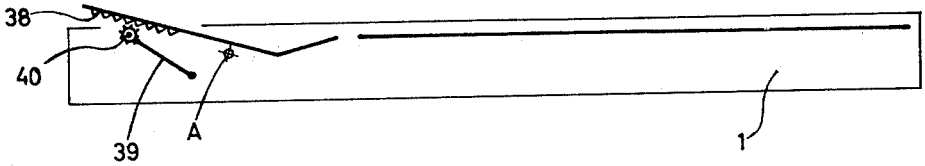

A third embodiment of the adjusting device is shown diagrammatically in FIGS. 11 and 14. In this case the rear face, preferably the two side pieces 9, of the head part includes in each case a rack 38 which engages a gear wheel 40 disposed on a support rod 39. The gearwheel 40 is held in constant engagement with the rack 38 by means of a spring 41. A brake mechanism, which may for example correspond to that described with reference to FIG. 13, is rigidly connected to the gearwheel 40. The operating direction of the brake mechanism should be set in such a way that raising the head part meets with slight resistance and lowering it meets with greater resistance.

Figure 10:
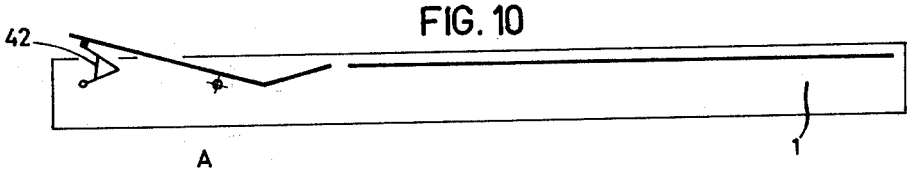

Various modifications may be made within the scope of the invention. For instance, as shown in FIG. 10, the infinitely variable adjustment may be replaced for example by means of a known scissor-like notched mechanism 42. Instead of the wedge 15 shown in FIG. 12 another braking device may also be used, for example one or more cylindrical rollers disposed between the support rod 10 and the oblique surface guide path 16 so that their end faces are adjacent to the support rods 10 on the one hand, and the oblique surface 16 on the other.

I claim:

1. An upper-mattress support for bed furniture comprising:

(a) a frame having a head part disposed thereon, a remaining reclining surface and a longitudinal axis;

(b) a foot of said under-mattress supporting means disposed inside same frame for supporting an over-mattress; and (c) adjusting means disposed between said head part and said frame, wherein said head part is divided by a pivoting axis, which is transverse to said longitudinal axis of said frame, into a larger section and a smaller section, (d) said smaller section being arranged nearer said foot than said larger section, and (e) said head part is pivotable about said pivoting axis so as to occupy an inclined portion with respect to said remaining reclining surface, (f) said adjusting means serving to fix said head portion in said inclined position, the position of said pivoting axis being selected such that, as said larger section is raised during pivoting of said head part, said smaller section is pivoted downwards below said reclining surface to thereby form and define a hollow for the shoulder region of a person lying on his side, (g) said head part has two parallel side pieces, on the inner surfaces of which are secured support members for bearing resilient cross-pieces extending transversely to said longitudinal axis of said under-mattress, (h) each of said side pieces being connected in an articulated manner at one end portion to a guide member which is pivotally mounted on said frame, there being play either at the point where said side piece and the guide member are connected or at the point where the guide member is attached to said longitudinal side pieces of said under-mattress, (i) a support member being disposed in the transition area between said side piece and said guide member.

2. An under-mattress support for bed furniture comprising:

(a) a frame having a head part disposed thereon, a remaining reclining surface and a longitudinal axis;

(b) a foot of said under-mattress supporting means disposed inside said frame for supporting an over-mattress; and (c) adjusting means disposed between said head part and said frame, wherein said head part is divided by a pivoting axis, which is transverse to said longitudinal axis of said frame, into a larger section and a smaller section, (d) said smaller section being arranged nearer said foot than said larger section, and (e) said head part is pivotable about said pivoting axis so as to occupy an inclined portion with respect to said remaining reclining surface, (f) said adjusting means serving to fix said head portion in said inclined position, the position of said pivoting axis being selected such that, as said larger section is raised during pivoting of said head part, said smaller section is pivoted downwards below said reclining surface to thereby form and define a hollow for the shoulder region of a person lying on his side, (g) said adjusting means have two support rods disposed in an articulated manner on respective ones of said side pieces of said head part and on said frame of said under-mattress, (h) each of said support rods being connected to a respective brake mechanism which exerts a braking force against the infinitely variable action of lowering said head part when raised.

3. An under-mattress support as set forth in claim 2, wherein each said braking mechanism has at least one braking member disposed in the path of motion of said support rod, said braking member being displaceably mounted with one side face on a guide path inclined with respect to the axis of the support rod and with the opposite side face directly adjacent to one face of said support rod in such a way that as said support rod moves downwards it displaces said braking member by increasing the frictional resistance between said support rod and said braking member.

4. An under-mattress support as set forth in claim 3, wherein said braking member is a wedge.

5. An under-mattress support as set forth in claim 3, wherein said brake member is a cylindrical roller and at least one further such roller is disposed between said support rod and said guide path in such a way that their end faces are adjacent said support rods and said guide path.

6. An under-mattress support for bed furniture comprising:

(a) a frame having a head part disposed thereon, a remaining reclining surface and a longitudinal axis;

(b) a foot of said under-mattress supporting means disposed inside said frame for supporting an over-mattress; and (c) adjusting means disposed between said head part and said frame, wherein said head part is divided by a pivoting axis, which is transverse to said longitudinal axis of said frame, into a larger section and a smaller section, (d) said smaller section being arranged nearer said foot than said larger section, and (e) said head part is pivotable about said pivoting axis so as to occupy an inclined portion with respect to said remaining reclining surface, (f) said adjusting means serving to fix said head portion in said inclined position, the position of said pivoting axis being selected such that, as said larger section is raised during pivoting of said head part, said smaller section is pivoted downwards below said reclining surface to thereby form and define a hollow for the shoulder region of a person lying on his side, (g) said adjusting means including two support rods disposed in an articulated manner on respective ones of said side pieces of said head part and on said frame of said under-mattress, (h) each of said support rods being connected to a respective brake mechanism which exerts a braking force against the infinitely variable action of lowering said head part when raised, (i) said brake mechanism has at least one brake ring, which is substantially frusto-conical in shape and is fastened rotatably rigidly on one side piece of said head piece, and a brake drum which is shaped similarly to said brake ring, projects into said brake ring and is pressed against the inner surface of said brake ring by the action of a spring, and (j) said brake drum is connected to said support rod by way of a ratchet mechanism whicn forcibly rotates the brake drum as said head part is lowered, and releases it as said head part is raised, thereby leaving it in its rest position with respect to said brake ring.

7. An under-mattress as set forth in claim 6, wherein on its side opposite said brake ring, said brake drum has a movably mounted, spring-loaded dog, and wherein said support rod engages with an associated, internally toothed ratchet wheel of said dog.

8. An under-mattress as set forth in claim 7, wherein said brake drum, said dog and said ratchet wheel are disposed freely rotatably on a bolt secured in said side piece of said head part and are held by a nut screwed onto the end of said bolt, it being possible to regulate the bearing pressure of a spring inserted between said nut and said ratchet mechanism by means of said nut.

9. An under-mattress support as set forth in claim 2, wherein at its upper end said support rod has a gear-wheel which is connected to a braking device and engages with a rack attached to the underside of said head part.

10. An under-mattress support as set forth in claim 1, wherein said head part is connected to said frame of said under-mattress by way of a scissors mechanism which permits a stepwise adjustment of the angle of said head part as the latter is raised.

11. An under-mattress support for bed furniture comprising:

(a) a frame having a longitudinal axis, (b) means for supporting an over-mattress including a head portion and a remaining reclining surface having a shoulder support section disposed inside said frame, (c) said head portion being divided into a larger section and a smaller section by a pivoting axis which extends transversely with respect to the longitudinal axis of the frame, (d) said smaller section extending into the shoulder support section and (e) adjusting means disposed between the head portion and the frame to fix said head portion in an inclined position, (f) the position of said pivoting axis being selected such that, as said larger section is raised with respect to the frame during pivoting of said head portion, said smaller section is pivoted downwardly below said reclining surface to define a hollow in the shoulder support section for the shoulder region of a person lying on his side, (g) said head portion has two parallel side pieces, on the inner surfaces of which are secured support members for bearing resilient cross-pieces extending transversely to said longitudinal axis of said under-mattress, (h) each of said side pieces being connected in an articulated manner at one end portion to a guide member which is pivotally mounted on said frame, there being play either at the point where said side piece and said guide member are connected or at the point where said guide member is attached to said longitudinal side pieces of said under-mattress, (i) a support member being disposed in the transition area between said side piece and said guide member within said shoulder support section.

12. An under-mattress support for bed furniture comprising:

(a) a frame having a longitudinal axis, (b) means for supporting an over-mattress including a head portion and a remaining reclining surface having a shoulder support section disposed inside said frame, (c) said head portion being divided into a larger section and a smaller section by a pivoting axis which extends transversely with respect to the longitudinal axis of the frame, (d) said smaller section extending into the shoulder support section and (e) adjusting means disposed between the head portion and the frame to fix said head portion in an inclined position, (f) the position of said pivoting axis being selected such that, as said larger section is raised with respect to the frame during pivoting of said head portion, said smaller section is pivoted downwardly below said reclining surface to define a hollow in the shoulder support section for the shoulder region of a person lying on his side, (g) said adjusting means includes two support rods disposed in an articulated manner on respective ones of said side pieces of said head portion and on said frame, (h) each of said support rods being connected to a respective brake mechanism which exerts a braking force against the infinitely variable action of lowering said head part when raised.

13. An under-mattress support as set forth in claim 12, wherein each said braking mechanism includes at least one braking member disposed in the path of motion of said support rod, said braking member being displaceably mounted with one side face on a guide path inclined with respect to the axis of the support rod and with the opposite side face directly adjacent to one face of said support rod in such a way that as said support rod moves downwardly it displaces said braking member by increasing the frictional resistance between said support rod and said braking member.

14. An under-mattress support as set forth in claim 13 wherein said braking member is a wedge.

15. An under-mattress support as set forth in claim 13, wherein said brake member is a cylindrical roller and at least one further such roller is disposed between said support rod and said guide path in such a way that their end faces are adjacent said support rods and said guide path.

16. An under-mattress support as set forth in claim 12, wherein a gearwheel is located at the upper end of each support rod which is connected to a braking device and said gearwheel engages a rack attached to the underside of said head portion.

17. An under-mattress support for bed furniture comprising:

(a) a frame having a longitudinal axis, (b) means for supporting an over-mattress including a head portion and a remaining reclining surface having a shoulder support section disposed inside said frame, (c) said head portion being divided into a larger section and a smaller section by a pivoting axis which extends transversely with respect to the longitudinal axis of the frame, (d) said smaller section extending into the shoulder support section and (e) adjusting means disposed between the head portion and the frame to fix said head portion in an inclined position, (f) the position of said pivoting axis being selected such that, as said larger section is raised with respect to the frame during pivoting of said head portion, said smaller section is pivoted downwardly below said reclining surface to define a hollow in the shoulder support section for the shoulder region of a person lying on his side, (g) said adjusting means includes a scissors mechanism which connects the head portion to the frame and permits a stepwise adjustment of the angle of said head portion as the latter is raised.

* * * * *